US010836608B2

(12) United States Patent
Peacock et al.

(10) Patent No.: US 10,836,608 B2
(45) Date of Patent: Nov. 17, 2020

(54) ELEVATOR ARRANGEMENT AND METHOD

(71) Applicant: Kone Corporation, Helsinki (FI)

(72) Inventors: Mark Peacock, Helsinki (FI); Sampo Koljonen, Helsinki (FI)

(73) Assignee: Kone Corporation, Helsinki (FI)

( * ) Notice: Subject to any disclaimer, the term of this patent is extended or adjusted under 35 U.S.C. 154(b) by 334 days.

(21) Appl. No.: 15/942,842

(22) Filed: Apr. 2, 2018

(65) Prior Publication Data

US 2018/0290863 A1 Oct. 11, 2018

(30) Foreign Application Priority Data

Apr. 10, 2017 (EP) ..... 17165776

(51) Int. Cl.
*B66B 11/00* (2006.01)
*E04G 3/18* (2006.01)
(Continued)

(52) U.S. Cl.
CPC ..... *B66B 11/0005* (2013.01); *B66B 5/005* (2013.01); *B66B 9/00* (2013.01); *B66B 11/0045* (2013.01); *E04G 3/18* (2013.01); *E04G 3/32* (2013.01); *E04G 21/24* (2013.01); *E04G 21/28* (2013.01); *B66B 19/00* (2013.01); *E04G 2003/286* (2013.01)

(58) Field of Classification Search
CPC ..... B66B 11/0005; B66B 5/005; B66B 9/00; B66B 11/0045; B66B 19/00; E04G 3/18; E04G 3/32; E04G 21/24; E04G 21/28; E04G 2003/286
See application file for complete search history.

(56) References Cited

U.S. PATENT DOCUMENTS 10,183,838 B2 * 1/2019 Weber ..... B66B 5/18
2009/0223751 A1 * 9/2009 Peacock ..... B66B 7/027 187/414

(Continued)

FOREIGN PATENT DOCUMENTS

CN 203374008 U 1/2014
EP 2636629 B1 5/2015
WO WO-2014/082971 A1 6/2014

OTHER PUBLICATIONS

Extended European Search Report #17165776 dated Sep. 13, 2017.

*Primary Examiner* — Michael A Riegelman
(74) *Attorney, Agent, or Firm* — Harness, Dickey & Pierce, P.L.C.

(57) ABSTRACT

The invention relates to a construction time elevator arrangement comprising a hoistway; a protection deck mounted within the hoistway for protecting the portion of the hoistway below it from falling objects; the protection deck comprising a roof member extending diagonally across the hoistway and covering the hoistway such that it blocks objects and/or water from falling into the hoistway below it; and a cross member extending in horizontal direction across the hoistway below the roof member. The cross member is pivotally connected with the roof member, the protection deck being collapsible into a transport state by pivoting the cross member and the roof member towards each other. The invention relates to a method implementing the construction time elevator arrangement.

17 Claims, 3 Drawing Sheets

(51) Int. Cl.

| | |
|---|---|
| ***B66B 9/00*** | (2006.01) |
| ***E04G 21/28*** | (2006.01) |
| ***B66B 5/00*** | (2006.01) |
| ***E04G 21/24*** | (2006.01) |
| ***E04G 3/32*** | (2006.01) |
| *B66B 19/00* | (2006.01) |
| *E04G 3/28* | (2006.01) |

(56) References Cited

U.S. PATENT DOCUMENTS

2010/0133048 A1* 6/2010 Barneman ..... B66B 19/00
187/414
2011/0113720 A1* 5/2011 Peacock ..... B66B 19/00
52/741.1
2012/0217101 A1* 8/2012 Peacock ..... B66B 11/00
187/414
2012/0291395 A1* 11/2012 Plathin ..... B66B 19/02
52/741.1
2013/0233655 A1* 9/2013 Peacock ..... B66B 19/00
187/414
2014/0000987 A1* 1/2014 Peacock ..... B66B 19/00
187/414
2015/0184402 A1* 7/2015 Gardner ..... E04G 3/28
182/131
2015/0298940 A1* 10/2015 Hense ..... B66B 19/00
187/254
2015/0307322 A1* 10/2015 Peacock ..... B66B 7/064
187/254
2017/0166419 A1* 6/2017 Rasanen ..... B66B 19/00
2017/0327348 A1* 11/2017 Blasi ..... B66B 9/00
2018/0186607 A1* 7/2018 Ratia ..... B66B 19/04
2018/0244494 A1* 8/2018 Talonen ..... B66B 5/005
2018/0290863 A1* 10/2018 Peacock ..... B66B 5/005
2019/0193995 A1* 6/2019 Christen ..... B66B 11/0005
2019/0194957 A1* 6/2019 Wurth ..... E04G 5/12
2019/0276277 A1* 9/2019 Christen ..... B66B 11/0005

* cited by examiner

ELEVATOR ARRANGEMENT AND METHOD

This application claims priority to european patent application No. EP17165776 filed on Apr. 10, 2017, the entire contents of which are incorporated herein by reference.

FIELD OF THE INVENTION

The invention relates an elevator arrangement and a method, and particularly to construction time protection of persons and/or components located in a lower portion of a hoistway of an elevator.

BACKGROUND OF THE INVENTION

When an elevator or a building surrounding it is under construction, there may be installation workers in the lower parts of the elevator hoistway carrying the actual construction work and/or the lower parts of the elevator may be already in construction time transport-use. During construction, there is an increased risk of objects or water falling into the lower parts of the hoistway. For example, water may rain or leak from above into the hoistway or tools or construction material may fall into the hoistway. Persons and components located in the lower parts of the hoistway must be protected from falling objects and/or water.

In prior art, the construction time elevator arrangement has been provided to comprise an overhead protection deck for protecting the portion of the hoistway below it from falling objects and/or water, which protection deck comprises a roof member extending across the hoistway and covering the hoistway such that it blocks objects and/or water from falling into the hoistway below it. This kind of protection deck has been disclosed in document EP2636629 B1.

A problem of the solutions of prior overhead protection decks has been that they have been difficult to implement in sites where the hoistway does not have pockets for receiving mounting members of the overhead protection deck. Moreover, the prior overhead protection decks have been slow and laborious to lift and guide it in the hoistway to an upper position without contacting the walls of the hoistway or other parts beside the overhead protection deck.

BRIEF DESCRIPTION OF THE INVENTION

The object of the invention is to introduce a new construction time elevator arrangement and a method for constructing an elevator. An object is to introduce a solution by which one or more of the above defined problems of prior art and/or problems discussed or implied elsewhere in the description can be solved. An object is particularly to introduce a solution by which construction time protection can be provided with a protection deck safely while maintaining ability to modify the configuration swiftly. Embodiments are presented, inter alia, wherein these objects are achieved with a simple structure.

It is brought forward a new construction time elevator arrangement comprising a hoistway; a protection deck mounted within the hoistway for protecting the portion of the hoistway below it from falling objects; the protection deck comprising a roof member extending diagonally across the hoistway and covering the hoistway such that it blocks objects and/or water from falling into the hoistway below it; and a cross member extending in horizontal direction across the hoistway below the roof member. The cross member is pivotally connected with the roof member, the protection deck being collapsible, in particular into a collapsed transport state, by pivoting the cross member and the roof member towards each other. With this solution one or more of the above mentioned objects can be achieved. The design provides that the protection deck can be swiftly shifted between two states, namely a service state and a transport state, in which transport state the space consumption is reduced compared to said service state. The reduced space consumption facilitates vertical movement of the protection deck within the hoistway. Preferable further details are introduced in the following, which further details can be combined with the arrangement individually or in any combination.

In a preferred embodiment, the cross member and the roof member are pivotal relative to each other around a horizontal axis.

In a preferred embodiment, the cross member is pivotally connected with the roof via at least one pivot joint, wherein the pivot joint can be a hinge for example.

In a preferred embodiment, when mounted as defined, the protection deck is in its service state and, the cross member and the roof member have a first angle, preferably within range 25-60 degrees, between them, and when the protection deck is in said transport state, the cross member and the roof member have a second angle, smaller than the first angle, between them. The second angle is preferably within range 0-15 degrees, more preferably within range 0-10, most preferably 0 degrees.

In a preferred embodiment, when the protection deck is in collapsed state, i.e. in said transport state, the cross member and the roof member are at least substantially parallel.

In a preferred embodiment, the roof member has a first end portion and a second end portion, and the cross member has a first end portion and a second end portion, and the first end portion of the roof member is pivotally connected the first end portion of the cross member.

In a preferred embodiment, when the protection deck is mounted as defined the first end portion of the roof member is at a substantially lower level than said second end portion of the roof member.

In a preferred embodiment, when the protection deck is mounted as defined the first end portion of the cross member is at a substantially at same level as said second end portion of the cross member.

In a preferred embodiment, the protection deck comprises an suspension member, which defines a hoisting point, and the protection deck has such a weight distribution that when the protection deck is in collapsed state, i.e. in transport state, the center of mass of the protection deck is between the first end portion of the roof member and the hoisting member, particularly when viewed in direction orthogonal to the upper face of the roof member.

In a preferred embodiment, the protection deck comprises an hoisting member, which defines a hoisting point, and the protection deck has such a weight distribution that when the protection deck is in collapsed state, i.e. in transport state, the center of mass of the protection deck is at a distance from the suspension member towards the first end portion of the roof member, said distance preferably being more than 5 cm, more preferably more than 10 cm.

In a preferred embodiment, the protection deck comprises an hoisting member, which defines a hoisting point, and the protection deck has such a weight distribution that when the protection deck is in collapsed state, and hoisted from said hoisting point, the protection deck pivots around the hoisting point such that the first and second end portion of the roof member pivot towards the center of the hoistway. Preferably, the protection deck pivots in said pivoting around the hoisting point less than 90 degrees, preferably 5-50 degrees, most preferably 5-20 degrees. Preferably, in said pivoting the first and second end portion of the roof member pivot towards but not beyond the vertical line passing through the hoisting point. Preferably, in said pivoting the angle of the roof member becomes steeper, preferably at least 10 degrees steeper.

In a preferred embodiment, the hoisting member is engageable with a hoisting member of a hoisting device for hoisting the protection deck, such as a hook or a chain or equivalent, of the hoisting device.

In a preferred embodiment, the roof member comprises said hoisting member.

In a preferred embodiment, the protection deck comprises a hoisting beam on which a hoisting device for hoisting structures, such as a working platform, below the protective deck can be connected.

In a preferred embodiment, the cross member is a working platform.

In a preferred embodiment, the elevator arrangement comprises an elevator car mounted in the hoistway below the protection deck.

In a preferred embodiment, the elevator arrangement comprises a movable support structure in the hoistway between the protective deck and the elevator car, for supporting the elevator car.

In a preferred embodiment, the elevator arrangement comprises a hoisting device for hoisting the elevator car, which hoisting device is mounted on said a movable support structure.

In a preferred embodiment, the elevator arrangement comprises a hoisting arrangement for hoisting the movable support structure higher in the hoistway so as to extend the service zone of a construction time elevator to reach higher in the elevator hoistway.

In a preferred embodiment, the elevator car is in construction time use for transporting passengers and/or goods below said protection deck.

In a preferred embodiment, the elevator arrangement furthermore comprises a roping for supporting the elevator car. The elevator car is preferably supported on the aforementioned movable support structure in the hoistway by the roping at least when the elevator car is used for transporting passengers and/or goods. The roping is preferably arranged to support the elevator car with 1:2 ratio, but alternatively the ratio could be any other ratio, such as 1:1 or 1:4, for example. The elevator arrangement can furthermore comprise a rope supply storage whereto the roping passes at one of its ends unbroken via a releasable fixing device, such as a releasable rope clamp. This provides that the elevator arrangement is very efficiently usable as a jump lift arrangement, because the length of the roping portion between rope fixing devices can be extended so that the traveling length of the car becomes longer.

In a preferred embodiment, the protection deck comprises a limiting means for limiting pivoting of the cross member and the roof member away from each other beyond a limit. Preferably, said limiting means comprises a flexible member, preferably a rope or a chain, connecting the second end portions of the cross member and the roof member.

In a preferred embodiment, the protection deck comprises a releasable locking means for locking the protection deck in its collapsed transport state at least for the time of transport.

In a preferred embodiment, the roof member is water proof.

In a preferred embodiment, the protection deck comprises a releasable locking means for locking the protection deck immovable relative to the building. Preferably, the locking means comprise engagement members to be engaged with a first side and second side of the hoistway, which first and second side are opposite sides of the hoistway. Said engagement members preferably, but not necessarily, comprise a first engagement member to be engaged with a first side of the hoistway, the first engagement member connecting the cross member and the roof member pivotally with each other; and a second engagement member to be engaged with the second side of the hoistway, the second a second engagement member being mounted on the second end portion of the roof member; and a third engagement member to be engaged with the second side of the hoistway, the third engagement member being mounted on the second end portion of the cross member. Preferably, but not necessarily, the second engagement member and the third engagement member are mounted movably on the roof member and the cross member, respectively, in such a way that they can be moved towards and into engagement with the second hoistway side, and back away from engagement with the second hoistway side. Preferably, but not necessarily, the first engagement member comprises a corner resting against a corner of a sill of a landing, the first engagement member comprising a first face resting against a vertical face of the hoistway, and a second face resting against a horizontal face of the sill.

In a preferred embodiment, the elevator arrangement comprises a hoisting arrangement for hoisting the protection deck higher in the hoistway.

In a preferred embodiment, the roof member comprises a planar upper face. Likewise, the cross member preferably also comprises a planar upper face.

It is also brought forward a new method for constructing an elevator comprising mounting a protection deck within the hoistway for protecting the portion of the hoistway below it from falling objects; which protection deck comprises a roof member extending diagonally across the hoistway and covering the hoistway such that it blocks objects and/or water from falling into the hoistway below it; and a cross member extending in horizontal direction across the hoistway below the roof member. The cross member is pivotally connected with the roof member, the protection deck being collapsible into a transport state by pivoting the cross member and the roof member towards each other. With this solution one or more of the above mentioned objects can be achieved. The design provides that the protection deck can be swiftly shifted between two states, namely a service state and a transport state, in which transport state the space consumption is reduced compared to said service state. The reduced space consumption facilitates vertical movement of the protection deck within the hoistway. Preferable further details are introduced in the following, which further details can be combined with the method individually or in any combination. Preferable further details of the arrangement in which the method is implements, have also been introduced in above following, which further details can be combined with the method individually or in any combination.

In a preferred embodiment, the method comprises demounting the protection deck and moving it vertically within the hoistway.

In a preferred embodiment, the demounting comprises shifting the protection deck into collapsed transport state.

In a preferred embodiment, the shifting into collapsed transport state comprises pivoting the cross member and the roof member towards each other.

In a preferred embodiment, the method comprises locking the cross member and the roof member in the transport state.

In a preferred embodiment, the protection deck comprises an hoisting member, which defines a hoisting point of the protection deck, and the protection deck has such a weight distribution that when the protection deck is in collapsed state, i.e. in transport state, the center of mass of the protection deck is between the first end portion of the roof member and the hoisting member, particularly when viewed in direction orthogonal to the upper face of the roof member, and said demounting comprises, after said shifting, hoisting the protection deck from said hoisting member, such that the protection deck pivots around the hoisting member such that the first and second end portion of the roof member pivot towards the center of the hoistway.

In a preferred embodiment, the protection deck is remounted in the hoistway.

In a preferred embodiment, the remounting comprises shifting the protection deck back into service state by pivoting the cross member and the roof member away from each other.

In a preferred embodiment, said moving the protection deck vertically within the hoistway comprises hoisting it from the hoisting member.

In a preferred embodiment, there is an elevator car mounted in the hoistway below the protection deck; and a movable support structure in the hoistway, separate from the protective deck and positioned between the protective deck and the elevator car, for supporting the elevator car, the method comprising using the elevator car for transporting passengers and/or goods; and thereafter hoisting the movable support structure higher in the hoistway; and thereafter using the elevator car again for transporting passengers and/or goods.

The elevator is preferably an elevator for transporting passengers and/or goods. The elevator is preferably such that the car thereof is vertically movable and configured to serve two or more vertically displaced landings. The elevator is furthermore preferably configured to control movement of the car in response to signals from user interfaces located at landing(s) and/or inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
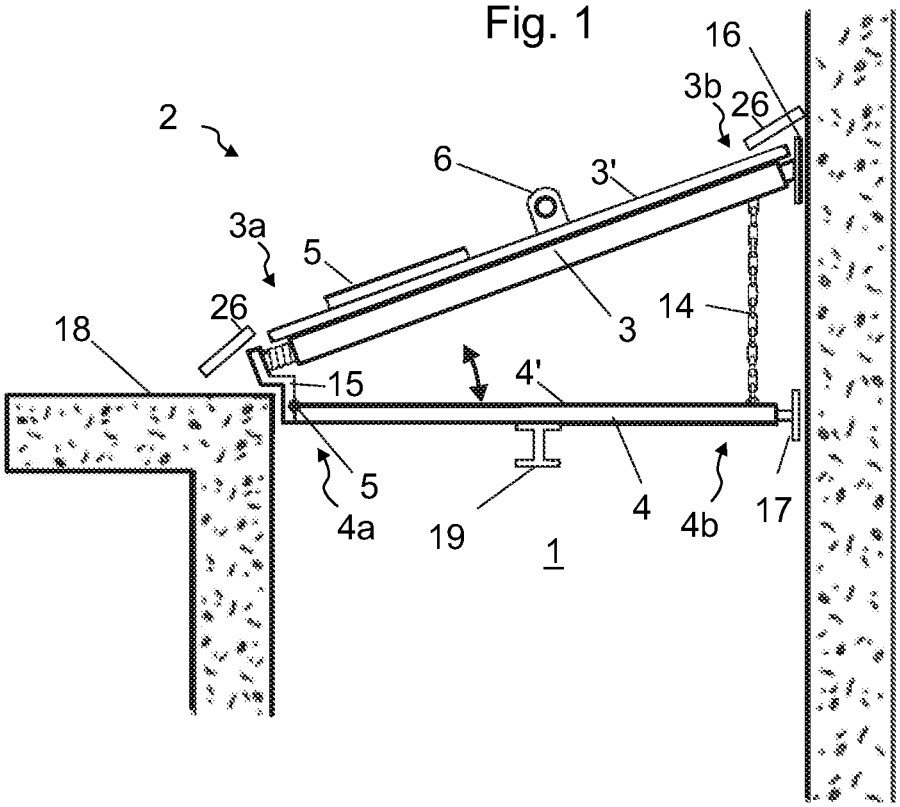
FIG. 1 illustrates an embodiment of a construction time elevator arrangement comprising a protection deck in its service state and mounted within a hoistway.

FIG. 1 illustrates a construction time elevator arrangement comprising a hoistway 1 formed inside a building, and a protection deck 2 mounted within the hoistway 1 for protecting the portion of the hoistway 1 below it from falling objects. The protection deck 2 is shiftable between a service state and a transport state. The protection deck 2 is in FIG. 1 in its service state, and comprises a roof member 3 extending diagonally across the hoistway 1 and covers the hoistway 1 such that it blocks objects and/or water from falling into the hoistway 1 below it. In addition to said roof member 3, the protection deck 2 comprises a cross member 4 extending in horizontal direction across the hoistway 1 below the roof member 3. The cross member 4 is advantageous for various reasons, and it can have one or more of the following functions of forming a working platform, forming a lateral stiffener for the protection deck 2, forming a base on which a hoisting device for hoisting structures below the protective deck can be connected, or forming a means to be used in engagement of the protection deck 2 with the hoistway 1. In the presented embodiment, the cross member 4 is pivotally connected with the roof member 3 and the protection deck 2 is collapsible into a transport state, i.e. into a collapsed transport state, by pivoting the cross member 4 and the roof 3 member towards each other. This provides that the protection deck 2 can be swiftly shifted between its service state and transport state, in which transport state the space consumption is reduced. The reduced space consumption facilitates vertical movement of the protection deck 2 within the hoistway 1. Pivotal design furthermore can be utilized in parking of the protection deck 2 stationary in the hoistway 1, by aid of a wedging effect as it makes it possible that the protection deck can expand in lateral direction. The roof member 3 preferably comprises planar upper face 3'. The roof member 3 is preferably water proof, for which purpose the upper face thereof is preferably water proof.

The cross member 4 is and the roof member 3 can particularly pivot relative to each other around a horizontal axis 5. The pivoting is implemented such that the cross member 4 is pivotally connected with the roof member 3 via at least one pivot joint 15, wherein the pivot joint 15 is preferably a hinge for example.

In the preferred embodiment, the roof member 3 has a first end portion 3*a* and a second end portion 3*b*, and the cross member 4 has a first end portion 4*a* and a second end portion 4*b*, and the first end portion 3*a* of the roof member 3 is pivotally connected with the first end portion of the cross member 4. The pivot joint 15 connects the first end portion 4*a* of the cross member 4 and the first end portion 3*a* of the roof member 3.

When the protection deck 2 is in its service state and mounted as defined, the first end portion 3*a* of the roof member 3 is at a substantially lower level than said second end portion 3*b* of the roof member 3. The first end portion 4*a* of the cross member 4 is at a substantially at same level as said second end 4*b* portion of the cross member 4.

Figure 2:
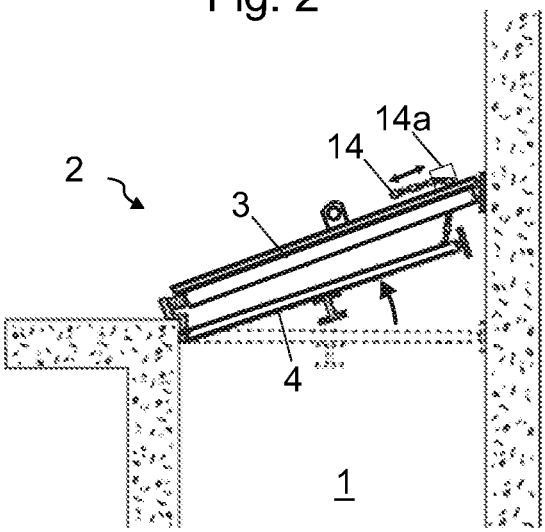
FIG. 2 illustrates the protection deck of FIG. 1 being shifted from its service state into its transport state.
Figure 3:
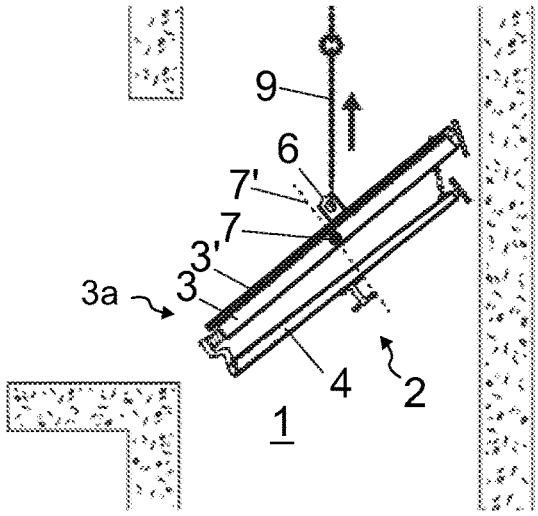
FIG. 3 illustrates the protection deck of FIG. 1 in its transport state and being hoisted in the hoistway.

When the protection deck 2 is in its service state and mounted as defined, the cross member 4 and the roof member 3 have a first angle, preferably an angle within range 25-60 degrees, between them, and when the protection deck 2 is in said transport state, the cross member 4 and the roof member 3 have a second angle, which is smaller than the first angle, between them. The second angle is preferably within range 0-15 degrees, more preferably within range 0-10, most preferably 0 degrees. FIG. 2 illustrates a step where the protection deck 2 is demounted, said demounting comprising shifting the protection deck 2 into collapsed transport state, said shifting into collapsed transport state comprising pivoting the cross member 4 and the roof member 3 towards each other. Most preferably, when the protection deck 2 is in collapsed state, i.e. in said transport state, the cross member 4 and the roof member 3 are at least substantially parallel, as illustrated in FIGS. 2 and 3. The aforementioned angles are measured from the upper faces 3' and 4' of the roof member 3 and the cross member 4.

The protection deck 2 comprises an hoisting member 6, which defines a hoisting point 6 of the protection deck 2, and the protection deck 2 has such a weight distribution that when the protection deck 2 is in collapsed state, i.e. in transport state, the center of mass 7 of the protection deck 2 is between the first end portion 3*a* of the roof member 3 and the suspension member 6, particularly when viewed in direction orthogonal to the upper face 3' of the roof member. Hereby, it is arranged that when the protection deck 2 is in collapsed state, and hoisted from said hoisting point 6, the protection deck pivots around the hoisting point 6 such that the first end portion 3*a* of the roof member 3 and second end portion 3*b* of the roof member 3 pivot towards the center of the hoistway 1. Thereby, the angle of the roof member 3 becomes steeper and the area that it covers of the hoistway cross section is reduced. In this pivoting, the protection deck 2 preferably pivots around the hoisting point 6 less than 90 degrees, preferably 5-50 degrees, most preferably 5-20 degrees. In this pivoting, the first and second end portion of the roof member 3 preferably pivot towards but not beyond the vertical line passing through the hoisting point 6. Hoisting from said hoisting point 6, and the attitude of the protection deck 2 after said pivoting has been illustrated in FIG. 3.

Preferably, when the protection deck 2 is in collapsed state, i.e. in transport state, the center of mass 7 of the protection deck 2 is at a distance from the suspension member 6 towards the first end portion of the roof member 3, said distance preferably being more than 5 cm, more preferably more than 10 cm.

The suspension member 6 is engageable with a hoisting member 9 of a hoisting device for hoisting the protection deck 2, such as a hook or a chain or equivalent, of the hoisting device. For this purpose, the suspension member preferably comprises a lifting eye.

The suspension member 6 is preferably comprised in the roof member 3, whereby the protection deck 2 pivots and settles into an advantageous attitude when hoisted.

The protection deck 2 also preferably, although not necessarily, comprises a hoisting beam 19, as illustrated, on which hoisting beam 19 a hoisting device 20 for hoisting structures, such as a working platform 22, below the protective deck 2 can be connected. The hoisting beam 19 also provides a simple way to adjust the weight distribution of the protection deck 2 to be between the first end 3*a* of the protection deck 2 and the hoisting point 6.

The cross member 4 is preferably, although not necessarily, a working platform, for which purpose it has a planar upper face 4' on which a person can stand. When the protection deck is mounted as defined in its service state, the planar upper face 4' is horizontal. The roof member 3 of the protection deck 2 preferably comprises an openable hatch 5, in particular through which a person standing on the working platform formed by the cross member 4 can reach the hoisting point 6.

It is preferable that the protection deck 2 comprises a limiting means 14 for limiting pivoting of the cross member 4 and the roof member 3 away from each other beyond a limit. Thus, the range of relative movement of these parts can be controlled. In the preferred embodiment presented, said limiting means 14 comprises a flexible member in the form of a chain, connecting the second end portions 3*b* and 4*b* of the cross member 4 and the roof member 3, respectively. The flexible member 14 could alternatively be in the form of a rope, cable, belt, or a flexible bracket comprising rigid metal parts pivotally connected to each other.

The protection deck 2 comprises a releasable locking means 14, 14*a* for locking the protection deck 2 in its collapsed transport state at least for the time of transport. The releasable locking means 14 comprise in the presented embodiment said limiting means 14 for limiting pivoting of the cross member 4 and the roof member 3 away from each other beyond a limit.

The releasable locking means are releasably tightenable to limit pivoting of the cross member 4 and the roof member 3 away from the transport state. For this purpose, the protection deck can comprise a lock 14*a*.

In the preferred embodiment, one end of the chain is fixed on the cross member 4 and the other end passes via a lock 14*a* mounted on the roof member 3. The lock is adapted to lock a variable point of the chain immovably relative to the roof member 3. Hereby, the length of the chain between the roof member 3 and the cross member 4 can be set to such that the roof member 3 and the cross member 4 cannot pivot away from the desired relative position, such as said transport state.

Figure 6:
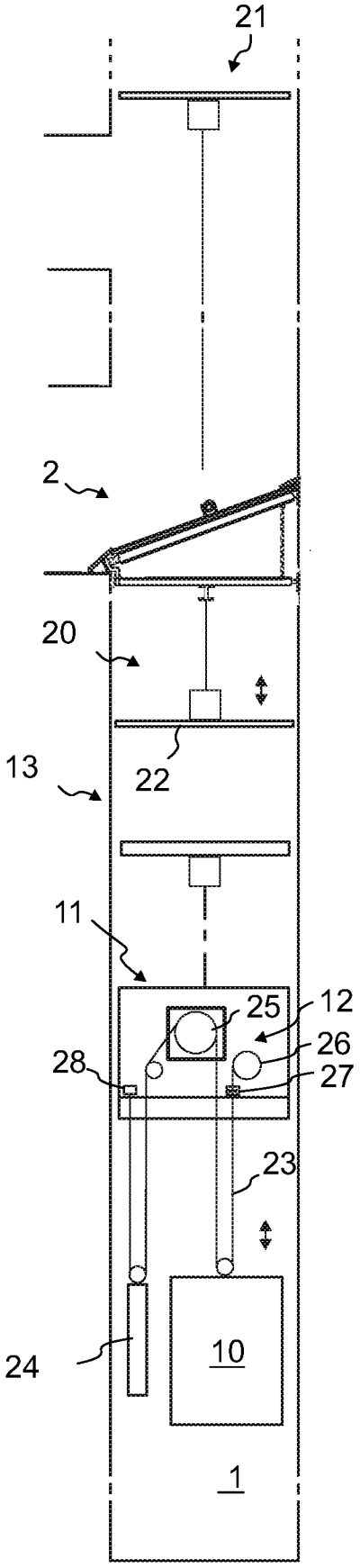
FIG. 6 illustrates preferable further details of the construction time elevator arrangement.

FIG. 6 illustrates preferable further details of the construction time elevator arrangement. In this case, the elevator arrangement comprises an elevator car 10 mounted in the hoistway 1 below the protection deck 2. The elevator arrangement comprises a movable support structure 11 in the hoistway 1, separate from the protective deck and positioned between the protective deck 2 and the elevator car 10, for supporting the elevator car 10. Thus, the service zone of a construction time elevator can be extended to reach higher in the elevator hoistway.

The elevator arrangement comprises a hoisting device 12 for hoisting the elevator car 10, which hoisting device 12 is mounted on said movable support structure 11. The elevator car 10 is in the presented embodiment supported by a roping 23 passing around a motor driven drive wheel 25 of the hoisting device 12. The roping 23 interconnects the car 10 with a counterweight 24. In the illustrated embodiment, the lifting ratio of the roping 23 is 1:2, but alternatively it could be any other ratio, such as 1:1 or 1:4, for example.

The elevator arrangement furthermore comprises a hoisting arrangement 13 for hoisting the movable support structure 11 higher in the hoistway 1 so as to extend the service zone of a construction time elevator to reach higher in the elevator hoistway. The elevator arrangement illustrated is thereby a so called jump-lift arrangement. The hoisting arrangement 13 can, for example, comprise a beam structure, a hoisting device and a rope, chain or equivalent, as illustrated in FIG. 6. Of course, the hoisting arrangement could be alternatively in some other form. The elevator car 10 is in construction time use for transporting passengers and/or goods below said protection deck 2. The elevator arrangement can comprise a working platform 22 movable below the protective deck 2. For enabling making room below the protection deck 2, the elevator arrangement comprises a hoisting arrangement 21 for hoisting the protection deck 2 higher in the hoistway.

In the illustrated embodiment, the elevator arrangement comprises a rope supply storage 26 whereto the roping 23 passes at one of its ends unbroken via a releasable fixing device 27, such as a releasable rope clamp. The other end of the roping 23 passes to a fixing device 28. The roping 23 passing into a rope supply storage 26 provides that the length of the roping portion between rope fixing devices 27 and 28 can be extended so that the traveling length of the car 1 becomes longer. The rope supply storage 26 can be mounted on the movable support structure 11 as illustrated, or alternatively it could be mounted on the building accommodating the elevator. The rope supply storage 26 can be in the form of one or more rope reels containing rope(s) wound such that the rope(s) can be unwound from the one or more rope reels, and guided further via the releasable fixing device 27 when it is in released state.

For providing simple mounting and demounting of the protection deck 2, it preferably comprises a releasable locking means 15, 16, 17 for locking the protection deck 2 immovable relative to the building. In the preferred embodiment, this is implemented such that the locking means 15, 16, 17 comprise engagement members 15, 16, 17 to be engaged with a first side and second side of the hoistway, which first and second side are opposite sides of the hoistway. Said engagement members 15, 16, 17 comprise a first engagement member 15 to be engaged with a first side of the hoistway 1, the first engagement member 15 connecting the cross member 4 and the roof member 3 pivotally with each other. The engagement members 15, 16, 17 moreover comprise a second engagement member 16 to be engaged with the second side of the hoistway 1, the second engagement member 16 being mounted on the second end portion 3*b* of the roof member 3. The engagement members 15, 16, 17 moreover comprise a third engagement member 17 to be engaged with the second side of the hoistway, the third engagement member being mounted on the second end 4*b* portion of the cross member. Preferably, the second engagement member and the third engagement member are mounted movably on the roof member 3 and the cross member 4, respectively, in such a way that they can be moved towards and into engagement with the second hoistway side, and back away from engagement with the second hoistway side. In the illustrated embodiment, the first engagement member 15 comprises a corner resting against a corner of a sill of a landing 18, the first engagement member comprising a first face resting against a vertical face of the hoistway 1, and a second face resting against a horizontal face of the sill. It is not necessary that the first engagement member 15 slightly movable relative to the roof member 3 and the cross member 4, but it may advantageous to provide slight movability on it too so that position thereof can be adjusted to fit the sill of the landing 18. The presented design of the locking means is advantageous, but of course alternatively various alternative kinds of locking means could be used for the locking function. The engagement member 15 can also have another function of forming part of the pivot joint as mentioned earlier, e.g. in the form of a hinge at it is the case in the embodiment of FIG. 1.

In a preferred embodiment of a method for constructing an elevator, a protection deck 2 is mounted within the hoistway 1 for protecting the portion of the hoistway below it from falling objects; which protection deck 2 comprises a roof member 3 extending diagonally across the hoistway and covering the hoistway such that it blocks objects and/or water from falling into the hoistway below it; and a cross member 4 extending in horizontal direction across the hoistway below the roof member 3, wherein the cross member 4 is pivotally connected with the roof member 3, the protection deck 2 being collapsible into a transport state by pivoting the cross member 4 and the roof member 3 towards each other. A construction time elevator arrangement as described earlier is particularly provided. The protection deck 2 is mounted as illustrated in FIG. 1 and described in related description. Thereafter, at a suitable moment, the protection deck 2 is demounted and moved vertically within the hoistway. Thus, more room is made below the protection deck. FIG. 2 illustrates the step of demounting. In the demounting the protection deck 2 is shifted into collapsed transport state, and in said shifting the cross member 4 and the roof member 3 are pivoted towards each other.

As a further step of said demounting, after said shifting the protection deck 2 is into collapsed transport state, the protection deck 2 is hoisted from said hoisting member 6, allowing the protection deck 2 to pivot around the hoisting member 6 such that the first and second end portion of the roof member (4) pivot towards the center of the hoistway 1. The pivoting takes place because the protection deck 2 comprises an hoisting member 6, which defines a hoisting point of the protection deck 2, and the protection deck 2 has such a weight distribution that when the protection deck 2 is in collapsed state, i.e. in transport state, the center of mass 7 of the protection deck 2 is between the first end portion 3*a* of the roof member 3 and the suspension member 6, particularly when viewed in direction orthogonal to the upper face 3' of the roof member (in direction of line 7' presented in FIG. 3). Hereby, it is arranged that when the protection deck 2 is in collapsed state, and hoisted from said hoisting point 6, the protection deck pivots around the hoisting point 6 such that the first end portion 3*a* of the roof member 3 and second end portion 3*b* of the roof member 3 pivot towards the center of the hoistway 1. Thereby, the angle of the roof member 3 becomes steeper and the area of the cross section of the hoistway covered by the protection deck 2 is reduced. In this pivoting, the protection deck 2 preferably pivots around the hoisting point 6 less than 90 degrees, preferably 5-50 degrees, most preferably 5-20 degrees. In this pivoting, the first and second end portion of the roof member 3 preferably pivot towards but not beyond the vertical line passing through the hoisting point. Hoisting from said hoisting point 6, and the attitude of the protection deck 2 after said pivoting has been illustrated in FIG. 3.

FIG. 3 illustrates a situation where the protection deck 2 has pivoted around the hoisting point 6 such that the first and second end portion 3*a*,3*b* of the roof member 3 has pivoted towards the center of the hoistway 1. In FIG. 3 the protection deck 2 is moved vertically within the hoistway 1. In said moving the protection deck 2 vertically within the hoistway, it is hoisted from said hoisting member 6, whereby the attitude resulting from said pivoting is maintained.

Figure 4:
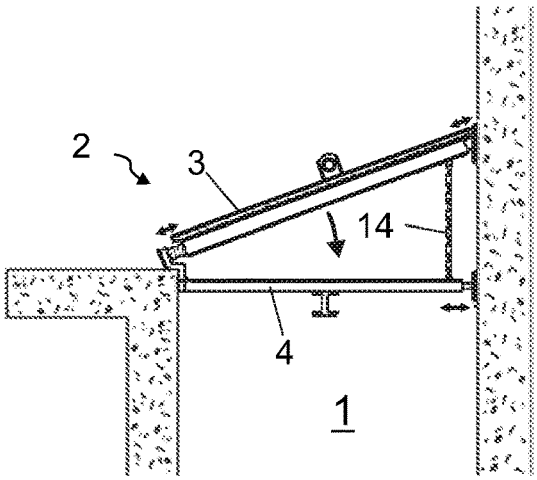
FIG. 4 illustrates the protection deck of FIG. 1 being shifted from its transport state into its service state.
Figure 5:
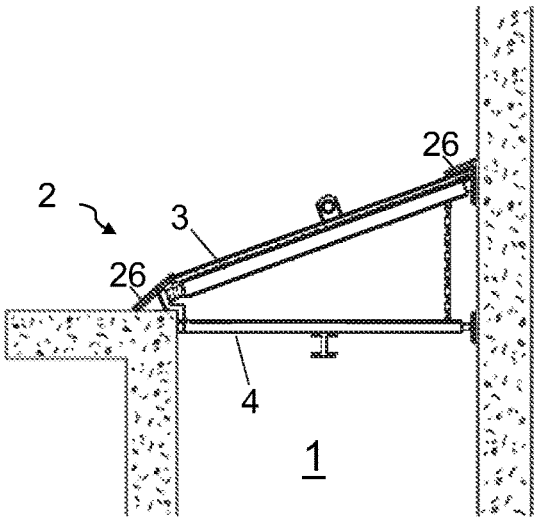
FIG. 5 illustrates the protection deck again in its service state and mounted within the hoistway.

After said moving vertically within the hoistway 1, the protection deck 2 is remounted in the hoistway 1, as illustrated in FIG. 4. The remounting comprises shifting the protection deck 2 back into service state by pivoting the cross member 4 and the roof member 3 away from each other. The limiting means 14 limit pivoting of the cross member 4 and the roof member 3 away from each other beyond a limit. As a step of said remounting, when the protection deck is suitably positioned, the releasable locking means 15, 16, 17 for locking the protection deck 2 immovable relative to the hoistway are activated. In this stage, also cover plates 26 can be added to cover the interface between the hoistway structures and the protection deck 2.

The method preferably comprises extending the service zone of a construction time elevator to reach higher in the elevator hoistway. In this case, there is an elevator car 10 mounted in the hoistway 1 below the protection deck (2); and a movable support structure 11 in the hoistway, separate from the protective deck 2 and positioned between the protective deck 2 and the elevator car 10, for supporting the elevator car 10. The method then comprises using the elevator car for transporting passengers and/or goods, and thereafter hoisting the movable support structure higher in the hoistway, and thereafter using the elevator car again for transporting passengers and/or goods. The moving of the protection deck 2 vertically in the hoistway 1 can take place at a suitable moment in the method, however it is generally preferable that it is performed between said steps of using the elevator car for transporting passengers and/or goods, and the subsequent hoisting the movable support structure 11 higher in the hoistway 1. An elevator arrangement implementing this method has been illustrated in FIG. 6 and further features described in the related description.

In the preferred embodiment, the cross member 4 and the roof member 3 are pivotal relative to each other around a single horizontal axis. This makes the protection deck 2 structurally simple and easy to use. However, this is not necessary as they could alternatively be arranged to be pivotal relative to each other around more than one horizontal axis. This could be used to facilitate compactness of the protection deck when in its transport state.

In the above, the construction time elevator arrangement provided with the collapsible protection deck 2 has been implemented particularly in a jump-lift arrangement and jump-lift method, where the service zone of a construction time elevator to reach higher in the elevator hoistway is extendable/extended. However, the protection deck is advantageous in an arrangement involving any kind of elevator construction work where a portion of the elevator hoistway needs to be protected, such as a regular elevator installation of a new elevator, or modernization work of an old elevator.

In the application, several details for the arrangement and the method have been presented as preferred. This means that they are preferred, however they are not to be understood as necessary, because it may be that the arrangement and/or the method can be implemented also without them.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A construction time elevator arrangement comprising:
a hoistway;
a protection deck mounted within the hoistway, the protection deck comprising a roof member extending diagonally across the hoistway and covering the hoistway such that the roof member blocks at least one falling objects or water from falling into a portion of the hoistway below the protection deck; and
a cross member extending horizontally across the hoistway below the roof member,
wherein the cross member is pivotally connected with the roof member, and the protection deck is configured to be collapsible into a transport state by pivoting the cross member and the roof member towards each other.

2. The construction time elevator arrangement according to claim 1, wherein the cross member and the roof member are pivotal relative to each other around a horizontal axis.

3. The construction time elevator arrangement according to claim 1, wherein
when the protection deck is mounted, the cross member and the roof member have a first angle between them, and
when the protection deck is in said transport state, the cross member and the roof member have a second angle between them, said second angle being smaller than said first angle.

4. The construction time elevator arrangement according to claim 3, wherein
the first angle is between 25 degrees and 60 degrees, and
the second angle is between 0 degrees and 10 degrees.

5. The construction time elevator arrangement according to claim 4, wherein the second angle is 0 degrees.

6. The construction time elevator arrangement according to claim 1, wherein
the roof member has a first end portion,
the cross member has a second end portion, and
the first end portion of the roof member is pivotally connected with the second end portion of the cross member.

7. The construction time elevator arrangement according to claim 1, wherein
the protection deck comprises a hoisting member defining a hoisting point of the protection deck, and
the protection deck is configured to have a weight distribution such that when the protection deck is in said transport state and hoisted from said hoisting point, the protection deck pivots around the hoisting member such that a first end portion of the roof member and a second end portion of the roof member pivot towards a center of the hoistway.

8. The construction time elevator arrangement according to claim 1, wherein
the protection deck comprises a hoisting member defining a hoisting point of the protection deck, and
the protection deck is configured to have a weight distribution such that when the protection deck is in said transport state, a center of mass of the protection deck is between a first end portion of the roof member and the hoisting member.

9. The construction time elevator arrangement according to claim 1, further comprising:
an elevator car mounted in the hoistway below the protection deck.

10. The construction time elevator arrangement according to claim 9, further comprising:
a movable support structure in the hoistway between the protective deck and the elevator car configured to support the elevator car.

11. A method for protecting a portion of a hoistway below a protection deck from falling objects, the method comprising:
mounting the protection deck within the hoistway,
wherein said protection deck comprises:
a roof member extending diagonally across the hoistway and covering the hoistway such that the roof member blocks at least one of the objects or water from falling into the portion of the hoistway below the protection deck; and a cross member extending horizontally across the hoistway below the roof member, wherein the cross member is pivotally connected with the roof member, and the protection deck is configured to be collapsible into a transport state by pivoting the cross member and the roof member towards each other.

12. The method according to claim 11, wherein the method further comprises:

demounting the protection deck; and moving the protection deck vertically within the hoistway, when the protection deck is in the transport state.

13. The method according to claim 12, wherein the demounting comprises:

shifting the protection deck into the transport state.

14. The method according to claim 13, wherein the shifting the protection deck into the transport state comprises:

pivoting the cross member and the roof member towards each other.

15. The method according to claim 13, wherein the protection deck comprises a hoisting member defining a hoisting point of the protection deck, the protection deck is configured to have a weight distribution such that when the protection deck is in said transport state, a center of mass of the protection deck is between a first end portion of the roof member and the hoisting member, and said demounting comprises, after said shifting, hoisting the protection deck from said hoisting member such that the protection deck pivots around the hoisting member and the first end portion of the roof member and a second end portion of the roof member pivot towards a center of the hoistway.

16. The method according to claim 11, further comprising:

remounting the protection deck in the hoistway, the remounting comprising shifting the protection deck back into service state, said shifting comprising pivoting the cross member and the roof member away from each other.

17. The method according to claim 11, wherein an elevator car is in the hoistway below the protection deck, a movable support structure is in the hoistway, separate from the protective deck and between the protective deck and the elevator car, and the method further comprises:

transporting at least one of passengers or goods using the elevator car;

hoisting the movable support structure higher in the hoistway; and transporting at least one of passengers or goods using the elevator car, after the hoisting the movable support structure.

* * * * *